United States Patent [19]

Ong et al.

[11] Patent Number: 4,562,132

[45] Date of Patent: Dec. 31, 1985

[54] PHOTORESPONSIVE IMAGING MEMBERS CONTAINING ELECTRON TRANSPORT OVERCOATINGS

[75] Inventors: Beng S. Ong, Mississauga; Barkev Keoshkerian, Willowdale; Dasarao K. Murti, Mississauga, all of Canada; Joseph Mammino, Penfield, N.Y.

[73] Assignee: Xerox Corporation, Stamford, Conn.

[21] Appl. No.: 672,749

[22] Filed: Nov. 19, 1984

[51] Int. Cl.[4] ..... G03G 5/14

[52] U.S. Cl. ..... 430/59; 430/66

[58] Field of Search ..... 430/58, 59, 66

[56] References Cited

U.S. PATENT DOCUMENTS

| | | | |
|---|---|---|---|
| 4,012,251 | 3/1977 | Turner | 96/1 PC |
| 4,013,623 | 5/1977 | Turner et al. | 260/63 UY |
| 4,116,691 | 9/1978 | Turner | 96/1.5 R |
| 4,135,928 | 1/1979 | Hashimoto et al. | 96/1.5 R |
| 4,153,802 | 5/1979 | Turner | 560/21 |
| 4,161,490 | 7/1979 | Turner | 260/465 |
| 4,225,692 | 9/1980 | Turner | 526/244 |
| 4,439,507 | 3/1984 | Pan et al. | 430/59 |
| 4,450,218 | 5/1984 | Takei et al. | 430/59 |
| 4,474,865 | 10/1984 | Ong et al. | 430/58 |

*Primary Examiner*—John L. Goodrow

*Attorney, Agent, or Firm*—E. O. Palazoo

[57] ABSTRACT

Disclosed is an imaging member comprised of a supporting substrate, a hole transport layer comprised of an arylamine hole transporting substance dispersed in an inactive resinous binder, a photogenerating layer comprised of a photogenerating pigment optionally dispersed in a resinous binder, and as a protective topcoating an electron transporting layer compound of the following formula dispersed in a resinous binder where X is cyano or alkoxycarbonyl groups, A and B are electron withdrawing groups, m is a number of from 0 to 2, n is the number 0 or 1, and W is an electron withdrawing group selected from the groups consisting of acyl, alkoxycarbonyl, alkylaminocarbonyl, and derivatives thereof.

31 Claims, 3 Drawing Figures

PHOTORESPONSIVE IMAGING MEMBERS CONTAINING ELECTRON TRANSPORT OVERCOATINGS

BACKGROUND OF THE INVENTION

This invention is generally directed to an imaging member, and more specifically the present invention is directed to the use of certain electron transporting compounds which when dissolved in suitable inactive resinous binder materials, function as protective overcoatings for photoresponsive imaging members. The overcoating selected may optionally be doped with certain electron donor compounds to enhance their long term structural stability and performance. Specifically, in one embodiment the present invention relates to a layered photoresponsive imaging member or device comprised of a photoconductive composition and overcoated thereover a 9-fluorenylidenemethane derivative dissolved in a polymer binder. Also, in another embodiment of the present invention there is provided an imaging member comprised of a hole transport layer, a photogenerating layer, and overcoated thereover as an electron transporting overcoating a polymer layer comprised of a 9-fluorenylidenemethane derivative. These imaging members are particularly useful in affecting the generation of latent images when positive charges have been applied thereto.

The electron transporting overcoating compounds selected for the imaging members of the present invention perform a variety of functions inclusive of desirable resistance to ozone, and to other reactive chemical substances produced by corona charging devices. Moreover, these coatings can be formulated as discrete layers which do not affect the intrinsic properties of the imaging members being protected. Furthermore, the 9-fluorenylidenemethane overcoatings of the present invention can function as a release material allowing the excellent release and transfer of toner images from the imaging member, and also, in certain liquid ink xerographic development processes, the coatings remain essentially nonreactive to the ink/solvent formulation utilized for development.

It is known that the application of protective coatings to certain photoconductive materials, particularly inorganic photoconductive materials, is designed primarily for the purpose of extending the useful life of the resulting devices. Generally in order for these coatings to provide the desired protection they should possess certain mechanical properties, and must be applied in a substantially uniform thickness. Additionally, the coating material should be selected so as to not adversely affect the photoelectric properties of the photoreceptor, for example, the coating should not appreciably inject charges in the dark. The protective coatings should also not conduct laterally on the overcoat surface. Further, in some applications the coating must be transparent, and possess a dark resistivity at least equal to the dark resistivity of the photoconductive material. For example, photoconductive materials such as selenium have a resistivity in the dark of $10^{10}$–$10^{12}$ ohm-cm, thus the dark resistivity of the protective coating should be in this range when such a coating is used as a protectant for selenium. In addition, the coatings should not be sensitive to humidity otherwise the photoelectric properties of the protected photoreceptors will change with humidity.

With regard to vitreous selenium, the most widely used photoconductive material, it suffers from two serious defects, namely, its spectral response is somewhat toward the blue or near ultraviolet, and the preparation of uniform films of vitreous selenium has required highly complex processes wherein critical parameters are involved. Accordingly, from a commercial economic aspect, it is important that xerographic selenium devices be utilized for numerous imaging cycles. The overcoatings of the present invention enable this objective to be achieved.

Deterioration by mechanical abrasion attendant to the developing and the cleaning processes, wherein in one cleaning process a rapidly rotating brush contacts the photoconductive surface for the purpose of removing therefrom any residual developer particles adhering thereto subsequent to the transfer step, has been observed in selenium. In addition to mechanical abrasion, the selenium photoreceptor may be subjected to intense heat, which over a period of time adversely affects its photoconductivity. Accordingly, and for other reasons, inclusive of preventing recrystallization of selenium upon exposure to solvent vapors, various protective coatings, or overcoatings have been applied to selenium devices. Thus, there is described in U.S. Pat. No. 3,397,982 an electrostatographic device comprising a photoconductive layer including an inorganic glass material, the photoconductive layer containing an overcoating comprised of various oxides, such as germanium oxides, the oxides of vanadium, and silicon dioxide.

Additionally, in U.S. Pat. No. 2,886,434 there is disclosed processes for the protection of selenium photoconductive substances with a thin transparent parent film of a material having electrical characteristics equal to selenium. Examples of materials disclosed as a protective layer for selenium include zinc sulfide, silica, various silicates, alkaline earth fluorides, and the like.

Furthermore, there is disclosed in U.S. Pat. No. 2,879,360 a photoconductive comprising a support substrate, a layer of photoconductive material, and as a protectant, a thin film of silicon dioxide superimposed upon the photoconductive layer.

Recently, there has been developed for use in xerographic imaging systems overcoated organic imaging members, including layered organic and layered inorganic photoresponsive devices. In one such photoresponsive device, there is employed a conductive substrate, overcoated with a hole injecting layer, which in turn is overcoated with a hole transport layer, followed by a carrier generating layer, and an insulating organic resin as a top coating. These devices have been found to be very useful in various imaging systems, and have the advantage that high quality images are obtained with the overcoating acting primarily as a protectant. The details of this type of overcoated photoreceptor are fully disclosed in U.S. Pat. No. 4,251,612 on a dielectric overcoated photoresponsive imaging member and imaging method.

Another similar overcoated photoresponsive device is comprised of a conductive substrate layer, a generating layer, and a transport layer. In such devices the generating layer can be overcoated on the transport layer, or the transport layer may be overcoated on the generating layer. Examples of such devices are described in U.S. Pat. No. 4,265,990, the disclosure of which is totally incorporated herein by reference.

Additionally, there is disclosed in U.S. Pat. No. 4,423,131 entitled Photoresponsive Devices Containing Polyvinylsilicate Coatings, improved photoresponsive imaging members with a protective overcoating top layer of a crosslinked polyvinylsilicate resulting from the reaction of polysilicic acid with a polyvinyl alcohol with a number average molecular weight of from about 10,000 to about 100,000.

Several of the above-described overcoated organic photoresponsive devices are not effectively protected after extended usage, and in some instances the imaging properties thereof are adversely affected subsequent to a few imaging cycles. More specifically, with these devices the properties of the top overcoating material, or the properties of the other layers are adversely affected by ozone, and other contaminants present in the environment by the developing compositions which contact the photoresponsive device for the purpose of rendering the image visible, and mechanical abrasion during cycling. Accordingly, images of low quality, or no images whatsoever are produced depending upon the extensiveness of the damage caused to the layers of the photoconductive device selected. Furthermore, in some instances, the toner materials employed do not sufficiently release from the photoresponsive surface, leaving unwanted toner particles thereon, causing them to be subsequently embedded into, or transferred from the imaging surface in later imaging steps, thereby resulting in undesirable images of low quality, and/or high background. Also, in some instances, the dried toner particles adhere to the imaging member and print out as background areas. This can be particularly troublesome when known silicone resins or elastomeric polymers are employed as overcoating materials for their melted toner release characteristics, since any low molecular weight components contained in these polymers can migrate to the surface of the silicone polymer layer, and act as an adhesive for dry toner particles brought in contact therewith during image development. There thus results undesirable high background areas in the final image since toner particles together with the developed images are effectively transferred to the receiving sheet.

While the above-described imaging members disclosed are suitable for their intended purposes, there continues to be a need for improved protective overcoatings for incorporation into layered imaging members. More specifically, there continues to be a need for protective overcoatings which simultaneously function as electron transporting media, enabling the resulting photoresponsive imaging members to be useful in xerographic imaging processes, particularly color processes, in that the members can be positively charged. Additionally, there continues to be a need for improved layered devices wherein the protective overcoating comprised of a composite of 9-fluorenylidenemethane derivative, and an inactive resinous binder. These coatings possess excellent toner release properties, and are impermeable to chemical materials produced by corona charging devices. Also, there continues to be a need for insulating protective overcoatings which simultaneously function as an electron transporting media, and wherein these overcoatings are not conductive to charges applied by a corona charging device. Furthermore, there remains a need for electron transport overcoatings which are mechanically strong and durable while simultaneously being insensitive to the effect of humidity. Also, there is a need for heat resistant overcoatings for layered photoresponsive imaging members which are capable of protecting these members from direct exposure to heat without adversely affecting their imaging performance. There also remains a need for protective overcoatings to prevent the escape of toxic materials, especially inorganic materials, such as arsenic and tellurium from photoreceptor imaging members. Moreover, there is a need for protective overcoating that will prevent photoconductors such as selenium from crystallization upon exposure to solvent vapors. The invention of the present application satisfies many of these needs.

SUMMARY OF THE INVENTION

It is an object of the present invention to provide an improved photoresponsive imaging member which overcomes some of the above-noted disadvantages.

In a further object of the present invention there is provided as overcoatings for photoresponsive imaging members 9-fluorenylidenemethane compositions in an inactive resinous binder, which overcoatings are chemical, heat and abrasion resistant, and transport electrons.

In another object of the present invention there are provided layered photoresponsive imaging members containing a photogenerating composition and coated thereover as protective overcoatings, a layer of insulating polymer comprised of 9-fluorenylidenemethane electron transporting compounds.

In still a further object of the present invention there are provided layered photoresponsive imaging members with a hole transporting substance, a photogenerating layer, and coated thereover as a protective layer a dispersion of 9-fluorenylidenemethane electron transporting compounds in a resinous binder.

In yet another object of the present invention there are provided layered photoresponsive imaging members containing as overcoatings dispersions of 9-fluorenylidenemethane derivatives in resinous binders, which overcoatings are insulating, and are thus not conductive or leaky to charges applied by a corona charging device.

In still another object of the present invention there are provided layered photoresponsive imaging members comprised of protective coatings composites of 9-fluorenylidenemethane electron transporting substances and insulating resinous binders, which members are useful for generating electrostatic latent images, particularly colored images, in xerographic imaging systems.

A further object of the present invention relates to the improved stability and enhanced performance of the above-mentioned overcoatings by doping with suitable electron donor compounds.

Another object of the present invention resides in the provision of humidity insensitive electron transporting protective overcoatings for photoresponsive devices.

These and other objects of the present invention are accomplished by the provision of layered photoresponsive imaging members having incorporated therein as protective overcoatings dispersions of 9-fluorenylidenemethane electron transporting compounds in suitable inactive resinous binders. These overcoatings may be further doped with electron donor molecules to improve their structural stability and electrical performance. More specifically, in one embodiment the present invention is directed to photoresponsive imaging members comprised of a supporting substrate, a photoconductive layer, a hole transport layer, and a protective polymer layer comprised of certain 9-fluorenylidenemethane electron transporting compositions. In another embodiment, the present invention is directed to a layered photoresponsive imaging member comprised of a supporting substrate, an arylamine hole transport layer, a photogenerating layer, and as an overcoating certain 9-fluorenylidenemethane electron transporting compounds dispersed in suitable resinous dielectric binder compositions.

The 9-fluorenylidenemethane overcoating derivatives selected for the imaging members of the present invention are preferably of the formula:

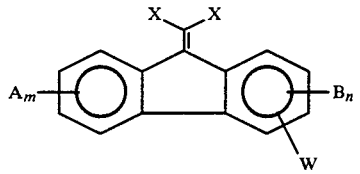

wherein X is cyano group (CN) or alkoxycarbonyl group (COOR), A and B are independently selected from electron withdrawing groups including acyl, alkoxycarbonyl, nitro, alkylaminocarbonyl, or derivatives thereof, m is a number of from 0 to 2, n is the number 0 or 1, and W is an electron withdrawing group, preferably selected from the group consisting of acyl (COR), alkoxycarbonyl (COOR), and alkylaminocarbonyl ($CONR^1R^2$), wherein R is an alkyl group, an aryl group, a substituted alkyl group or a substituted aryl group, and $R^1$ and $R^2$ are hydrogen, alkyl groups or aryl groups. These derivatives are disclosed in U.S. Pat. No. 4,474,865, the disclosure of which is incorporated herein by reference.

Illustrative examples of acyl groups (COR) are acetyl, propionyl, isovaleryl, anisoyl, stearoyl, and the like, with isovaleryl being preferred. Examples of alkoxycarbonyl groups (COOR) include methoxycarbonyl, ethoxycarbonyl, isopropoxycarbonyl, n-butoxycarbonyl, phenethoxycarbonyl, carbitoxycarbonyl, and the like, while representative examples of alkylaminocarbonyl groups ($CONR^1R^2$) include propylaminocarbonyl, n-butylaminocarbonyl, diethylaminocarbonyl, 2-methoxyethylaminocarbonyl, stearylaminocarbonyl, and the like.

Illustrative examples of alkyl groups include those of from 1 carbon atom to 20 carbon atoms, and preferably from 1 to 8 carbon atoms such as methyl, ethyl, propyl, butyl, pentyl, hexyl, heptyl and octyl. Preferred alkyl substituents are methyl, ethyl, propyl and butyl. Aryl groups include those with from 6 to 24 carbon atoms such as phenyl, tolyl, biphenyl, naphthyl, with phenyl and tolyl being preferred.

Illustrative specific examples of electron transporting 9-fluorenylidenemethane overcoating derivatives include those encompassed by the following formulas:

I.

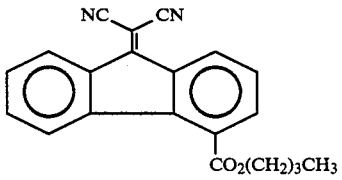

(4-n-BUTOXYCARBONYL-9-FLUORENYLIDENE) MALONONITRILE

-continued

II.

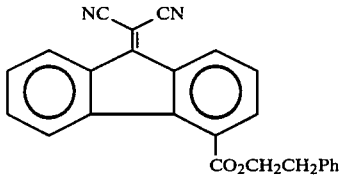

(4-PHENETHOXYCARBONYL-9-FLOURENYLIDENE) MALONONITRILE

III.

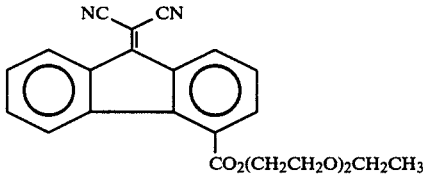

(4-CARBITOXYCARBONYL-9-FLUORENYLIDENE) MALONONITRILE

IV.

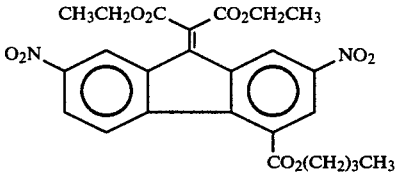

(4-n-BUTOXYCARBONYL-2,7-DINITRO-9-FLUORENYLIDENE) MALONATE

V.

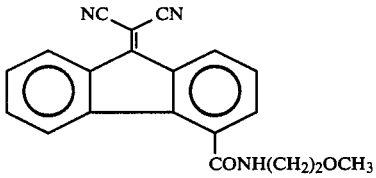

[4-(2-METHOXYETHYLAMINOCARBONYL)-9-FLUORENYLIDENE] MALONONITRILE

VI.

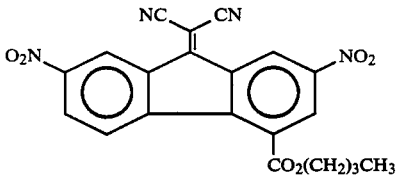

(4-n-BUTOXYCARBONYL-2,7-DINITRO-9-FLUORENYLIDENE) MALONONITRILE

The 9-fluorenylidenemethane compositions are prepared as described in U.S. Pat. No. 4,474,865 the disclosure of which is totally incorporated herein by reference. More specifically, for example, these materials can be prepared by reaction schemes 1 and 2 as detailed in the copending application. Thus, the acid-catalyzed esterification of the fluorenone-carboxylic acid derivative (1) to ester (3) can be achieved by refluxing this substance with a 10 to 30-fold molar excess of an alcohol, such as ethanol, or butanol, in a suitable solvent inclusive of benzene, toluene, xylene and the like, in the presence of a catalytic amount of concentrated sulfuric acid or p-toluenesulfonic acid. The solvent should be capable of forming an azeotrope with water, enabling any water generated by the reaction to be removed azeotropically by means of a Dean-Stark apparatus. In general, the esterification is completed in from about 12 to 36 hours. Alternatively, the carboxylic acid can be first converted to the corresponding acid chloride (2) by refluxing in thionyl chloride (50–150 milliliters per 0.1 mole of carboxylic acid) for 1 to 5 hours, followed by treatment with a stoichiometric quantity, or an excess of an alcohol in the presence of a stoichiometric excess of triethylamine present in a suitable dried solvent such as methylene chloride or tetrahydrofuran at room temperature. The carboxylic ester (3) obtained can generally be purified by simple recrystallization from a suitable solvent. Subsequent dicyanomethylenation of the fluorenone-carboxylate (3) is accomplished by refluxing with 1.5 to 3-fold excess of distilled malononitrile in absolute methanol in the presence of a catalytic amount of piperidine for 12 to 36 hours. The extent of the esterification and dicyanomethylenation reactions can be conveniently followed by thin layer chromatography, and the products can be identified by spectroscopic means, including IR, NMR and Mass spectrometry.

The alternative reaction illustrated in Scheme 2 of the copending application involves an initial dicyanomethylenation of fluorenone-carboxylic acid (1) to the corresponding dicyanomethylene compound (5). The dicyanomethylenation reaction is effected in the same manner as described herein for Scheme 1, except that a longer reaction time is required, about 24 to about 50 hours. The conversion of (5) to the corresponding acid chloride (6) can be accomplished by treatment with excess thionyl chloride under reflux conditions for 2 to about 10 hours.The acid chloride is purified by recrystallization from methylene chloride and hexane. Subsequent reaction with an alcohol to form the corresponding ester (4) is generally accomplished at room temperature in dried methylene chloride or tetrahydrofuran, in the presence of a stoichiometric excess of triethylamine. The amount of alcohol employed in the reaction can be a stoichiometric quantity to an excess. The reaction is generally completed in 1 to about 5 hours, and the products are identified as disclosed herein with reference to reaction Scheme 1.

The 9-fluorenylidenemethane electron transporting overcoatings are applied to the imaging members in a thickness that will enable the objectives of the present invention to be achieved. Generally, the thickness of this layer is from about 0.1 micron to about 10 microns, and preferably from about 0.5 micron to about 5 microns.

DESCRIPTION OF PREFERRED EMBODIMENTS

Figure 1:
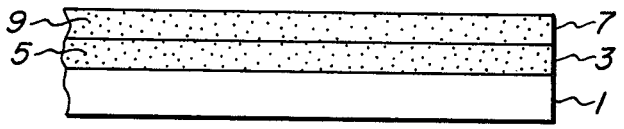
Figure 2:
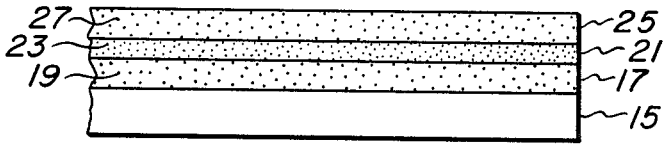
Figure 3:
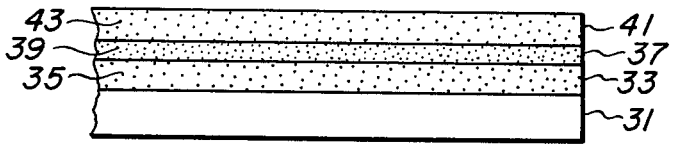

The invention will now be illustrated with reference to specific preferred embodiments wherein:

FIGS. 1, 2 and 3 represent cross-sectional views of the photoresponsive imaging member of the present invention.

There is illustrated in FIG. 1 a photoresponsive imaging member of the present invention comprised of a supporting substrate 1; a photoconductive layer 3 comprised of a photogenerating material optionally dispersed in a resinous binder 5, which layer is of a thickness of from about 20 microns to about 100 microns, and preferably is of a thickness of 60 microns, thereby enabling the photogeneration and transport of charge; and a protective layer 7 comprised of the 9-fluorenylidenemethane derivatives illustrated herein optionally dispersed in a resinous binder 9.

Illustrated in FIG. 2 is a positively charged photoresponsive imaging member comprised of a supporting substrate 15; an aromatic diamine hole transport layer 17 comprised of an aryl diamine dispersed in an inactive resinous binder 19; a photogenerating layer 21, in contact therewith, optionally dispersed in a resinous binder 23; and a top overcoating 25 comprised of 9-fluorenylidenemethane electron transporting compositions dispersed in a resinous binder 27.

Illustrated in FIG. 3 is a preferred photoresponsive imaging member of the present invention comprised of an aluminized Mylar substrate 31; a hole transport layer 33 with an arylamine hole transporting composition dispersed in a polycarbonate resinous binder 35; a photogenerating layer 37 comprised of an inorganic photogenerating material, including selenium and selenium alloys, or an organic photogenerating layer comprised of, for example, a vanadyl phthalocyanine, optionally dispersed in a resinous binder 39; and a protective overcoating 41 comprised of the electron transporting substance (4-alkoxycarbonyl-9-fluorenylidene)-malonitrile, and an optional electron donor molecule, inclusive of the aryl amines illustrated herein, dispersed in a resinous binder 43.

The photoresponsive imaging members disclosed herein are useful in various imaging systems, particularly electrostatic imaging systems wherein the devices are initially charged positively, followed by imagewise exposure thereof, development of the resulting latent image with a developer composition comprised of toner resin particles and carrier particles, followed by transfering the developed image to a suitable substrate such as paper, and permanently affixing the image thereto. As the devices can be positively charged, they can be conveniently selected for the generation of colored images using negatively charged toner compositions, thus avoiding the need for the incorporation of charge enhancing additive substances. Toners and developer compositions that may be selected for image development with the photoconductive members of the present invention are well known, and include, for example, compositions comprised of toner resins; pigment particles, inclusive of cyan, magenta, and yellow pigments; and carrier particles, reference copending application U.S. Ser. No. 621,977, entitled Positively Charged Toner Compositions Containing Phosphonium Charge Enhancing Additives; and U.S. Pat. No. 4,312,932, which also illustrates a color development process. The disclosure of each of these documents is totally incorporated herein by reference. Specific examples of resin particles are styrene methacrylates, styrene acrylates, styrene butadienes, polyesters, and other similar polymers.

With reference to the photoresponsive imaging members illustrated herein, and in particular with reference to FIGS. 1 to 3, the substrate layers may be comprised of any suitable material having the requisite mechanical properties. Thus, the substrate layers may comprise a layer of conductive materials such as metallized organic polymeric materials, or inorganic materials such as, for example, aluminum, chromium, nickel, brass, or the like. The substrate may be flexible or rigid, and may be of a number of many different configurations, such as, for example, a plate, a cylindrical drum, a scroll, an endless flexible belt, and the like. Preferably, the substrate is in the form of an endless flexible belt or a rigid drum.

The photogenerating layers can be comprised of known photoconductive charge carrier generating materials including, for example, amorphous selenium, amorphous selenium alloys, halogen-doped amorphous selenium, halogen-doped amorphous selenium alloys, trigonal selenium, selenide and carbonates with trigonal selenium, reference U.S. Pat. Nos. 4,232,102 and 4,233,283, cadmium sulfide, cadmium selenide, cadmium telluride, cadmium sulfur selenide, cadmium sulfur telluride, cadmium seleno telluride, copper and chlorine-doped cadmium sulfide, and the like. Alloys of selenium included within the scope of the present invention include selenium tellurium alloys, selenium arsenic alloys, selenium tellurium arsenic alloys, and preferably such alloys containing the halogen material, such as chlorine, in an amount of from about 50 to about 200 parts per million.

Other photogenerating layers include metal phthalocyanines, metal-free phthalocyanines, vanadyl phthalocyanines, other known phthalocyanines as disclosed in U.S. Pat. No. 3,816,118 the disclosure of which is totally incorporated herein by reference, squarylium pigments, and the like. Preferred photogenerating layers include trigonal selenium, squarylium pigments and vanadyl phthalocyanine.

The photogenerating layers of FIGS. 2 and 3, are generally of a thickness of from about 0.05 micron to about 10 microns or more, and preferably are of a thickness of from about 0.4 microns to about 3 microns, however, the thickness of this layer is primarily dependent on the photoconductive volume loading, which may vary from 5 to 100 volume percent. With respect to FIG. 1, the photoconductive layer, which generates and transports charge is of a thickness of from about 20 microns to about 100 microns, and preferably is of a thickness of about 60 microns.

The photogenerating layer generally comprises the above-described photogenerating pigments dispersed in an inactive resinous binder composition, in amounts of from about 5 percent by weight to about 95 percent by weight, and preferably in amounts of from about 25 percent by weight to about 75 percent by weight. Illustrative examples of polymeric binder resinous materials that can be selected include those as disclosed, for example, in U.S. Pat. No. 3,121,006, the disclosure of which is totally incorporated herein by reference, polyesters, polyvinylbutyral polycarbonate resins, polyvinylcarbazole, carbazole, epoxy resins, phenoxy resins, especially the commercially available poly(hydroxyether)resins, and the like.

The electron transporting overcoat is of a thickness of from about 0.1 microns to about 10 microns, and preferably is of a thickness of from 0.5 microns to about 5 microns.

Also, the electron transporting material is generally dispersed in a highly insulating and transparent resinous material or inactive resinous binder material, including those as described in U.S. Pat. No. 3,121,006 the disclosure of which is totally incorporated herein by reference. Specific examples of resinous materials include polycarbonates, acrylate polymers, vinylpolymers, cellulose polymers, polyesters, polysiloxanes, polyamides, polyurethanes, and epoxies, as well as block, random or alternating copolymers thereof. Preferred electrically inactive binder materials are polycarbonate resins having a molecular weight of from about 20,000 to about 100,000, with a molecular weight in the range of from about 50,000 to about 100,000 being particularly preferred. Generally, the resinous binder is present in the electron transporting layer in an amount of from about 25 percent by weight to about 75 percent by weight, and preferably from about 50 percent by weight to about 65 percent by weight. Other inactive resinous binder materials can be selected for the electron transporting overcoat providing the objectives of the present invention are achieved, including, for example, polyhydroxy ethers, such as those commercially available from Union Carbide, and the like.

Various hole transport layer compositions can be selected providing these substances are capable of transporting holes, this layer generally having a thickness in the range of from about 5 to about 50 microns, and preferably from about 20 to about 40 microns. Thus, the transport layer comprises molecules of the formula:

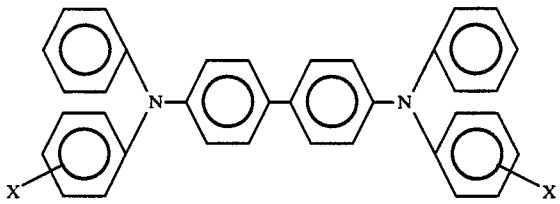

dispersed in a highly insulating and transparent organic resinous material wherein X is selected from the group consisting of alkyl, and halogen, preferably (ortho) $CH_3$, (meta) $CH_3$, (para) $CH_3$, (ortho) Cl, (meta) Cl, (para) Cl. The charge transport layer is substantially non-absorbing in the spectral region of intended use, that is, visible light, but is "active" in that it allows injection of photogenerated holes from the charge generator layer. The resin becomes electrically active when it contains from about 10 to 75 weight percent of the substituted N,N,N',N'-tetraphenyl-1,1'-[biphenyl]-4,4'-diamines corresponding to the foregoing formula. Compounds corresponding to this formula include, for example, N,N'-diphenyl-N,N'-bis-(alkylphenyl)-1,1'-[biphenyl]-4,4'-diamine wherein alkyl is selected from the group consisting of methyl such as 2-methyl, 3-methyl and 4-methyl, ethyl, propyl, butyl, hexyl and the like. With halogen substitution, the compound is N,N'-diphenyl-N,N'bis(halophenyl)-1,1'-biphenyl-4,4'-diamine wherein the halogen atom is 2-chloro, 3-chloro or 4-chloro.

Other electrically active small molecules which can be dispersed in the electrically inactive resin to form a layer which will transport holes include triphenylamine, and bis-(4-diethylamino-2-methylphenyl)-phenylmethane; and bis-(4-diethylamino phenyl)-phenylmethane.

With reference to the photoresponsive device of FIG. 1, the photoconductive layer may be comprised of known photoconductive materials including, for example, amorphous selenium alloys, halogen-doped amorphous selenium and selenium alloys, cadmium sulfide, cadmium selenide, cadmium telluride, cadmium sulfur selenide, cadmium sulfur telluride, copper and chlorine-doped cadmium sulfide, and the like. Alloys of selenium included within the scope of the present invention include selenium tellurium alloys, selenium arsenic alloys, selenium tellurium arsenic alloys, and preferably such alloys containing the halogen material, such as chlorine, in an amount of from 50 to about 200 parts per million.

The invention will now be described in detail with respect to specific preferred embodiments thereof, it being understood that these examples are intended to be illustrative only, and the invention is not intended to be limited to the materials, conditions, process parameters recited herein. All percentages and parts are by weight unless otherwise indicated.

EXAMPLE I

Preparation of (4-n-butoxycarbonyl-9-fluorenylidene)malononitrile (I):

In a 5,000-milliliter, round-bottomed flask equipped with a Dean-Stark apparatus and a water condenser, were placed 100 grams (0.446 mole) of fluorenone-4-carboxylic acid, available from Aldrich Chemicals, 650 grams of n-butanol, 5 milliliters of concentrated sulfuric acid, and 2,000 milliliters of toluene. The mixture was magnetically stirred and heated under reflux for 24 hours, followed by cooling to room temperature. The n-butanol and toluene solvent were then evaporated under reduced pressure in the presence of 10 grams of sodium bicarbonate. Subsequently, 1,000 milliliters of methylene chloride was added to the residue, and the resulting solution was washed twice with dilute aqueous sodium bicarbonate solution, and twice with water. After drying with anhydrous magnesium sulfate, the solution was filtered and evaporated under reduced pressure, resulting in 120 grams of n-butyl fluorenone-4-carboxylate.

The resulting ester, 120 grams, was placed in a 2,000 milliliter round-bottomed flask. To this was added 1,000 milliliters of absolute methanol, 59 grams (0.89 mole) of malononitrile, and 25 drops of piperidine. The mixture was stirred magnetically, and heated under reflux for 20 hours. The solid product from the cooled reaction mixture was filtered, washed twice with 100 milliliters of methanol, once with 200 milliliters of water, and dried under vacuum at 50° C. for 10 hours. The resulting product was then recrystallized from acetone and methanol, yielding 123 grams of pure (4-n-butoxycarbonyl-9-fluorenylidene)malononitrile melting point 99°–100° C.

Analytical Calculation for $C_{21}H_{16}N_2O_2$:

| Calculated | Found |
|---|---|
| C, 76.81 | C, 76.52 |
| H, 4.91 | H, 5.04 |
| N, 8.53 | N, 8.28 |

The compound was further identified by spectroscopic means, with the following results:

NMR ($CDCl_3$), delta: 1.0 (t, 3H); 1.5 (m, 2H); 1.8 (m, 2H); 4.5 (t, 2H); 7.3–8.7.t (m, 7H).

IR (KBr pellet): 2240 $cm^{-1}$ (CN); 1730 $cm^{-1}$ (C═O).

EXAMPLE II

Preparation of (4-phenethoxycarbonyl-9-fluorenylidene)malononitrile (II):

(a) Preparation of precursor (4-carboxy-9-fluorenylidene)malononitrile: A mixture of 93.1 grams (0.415 mole) of fluorenone-4-carboxylic acid and 750 milliliters of absolute methanol was magnetically stirred and heated to reflux temperature in a 2,000 milliliter round-bottomed flask fitted with a reflux condenser. Subsequently, there was added to the flask 82.3 grams (1.25 mole) of malononitrile and 20 drops of piperidine. This mixture was then heated under reflux for 48 hours. The solid product (4-carboxy-9-fluorenylidene)-malononitrile, was collected by suction filtration, and purified by stirring in 500 millilters of boiling methanol for 15 minutes, followed by filtration and washing successively with 200 milliliters of methanol. The product was dried under vacuum at 65° C. for 12 hours and weighed 90.1 grams.

(b) Preparation of (4-chloroformyl-9-fluorenylidene)-malononitrile: A mixture of 27.44 grams (0.10 mole) of (4-carboxy-9-fluorenylidene)malononitrile as obtained above, and 150 milliliters of thionyl chloride in a 250 milliliter round-bottomed flask equipped with a reflux condenser was magnetically stirred and heated under reflux in a dry nitrogen atmosphere for 6 hours. The solid acid dissolved after 1 hour's heating. As the reaction proceeded, the reaction mixture turned brownish in color and became dark brown at the end of the reaction. The reaction mixture was then evaporated at reduced pressure resulting in a solid residue, and 300 milliliters of dichloroethane was added to this crude product. Evaporation under reduced pressure was continued to remove traces of thionyl chloride. The crude product was recrystallized from methylene chloride/hexane (350 ml/400 ml). The pure (4-chloroformyl-9-fluorenylidene)malononitrile obtained weighed 27.99 grams after drying under vacuum at 40° C. for 12 hours.

(c) Preparation of Compound (II): 8.5 grams (0.03 mole) of (4-chloroformyl-9-fluorenylidene)malononitrile was dissolved in 150 milliliters of dried methylene chloride in a 250 milliliter round-bottomed flask under a dry nitrogen atmosphere. The solution was magnetically stirred at room temperature. A solution of 3.67 grams (0.03 mole) of phenethyl alcohol and 4.5 milliliters of triethylamine in 30 milliliters of methylene chloride was added dropwise by means of a pressure-equalizing dropping funnel over a period of 10 minutes. After the addition, the reaction mixture was allowed to react at room temperature for 4 hours. The mixture was poured into a 500 milliliter separatory funnel and washed with dilute aqueous sodium bicarbonate solution (3 times) and then water (2 times), dried with anhydrous magnesium sulfate, and filtered. The filtrate was evaporated at reduced pressure to give crude Compound (II) which was recrystallized from methylene chloride/hexane. The yield of pure product was 8.3 grams. The melting point was 115°–117° C.

Analytical calculation for $C_{25}H_{16}N_2O_2$: C, 79.77; H, 4,28; N, 7.44.

Found: C, 79.82; H, 4.41; N, 7.42.

NMR ($CDCl_3$), delta: 3:15 (t, 2H); 4.65 (t, 2H); 7.2–8.6 (m, 12H).

IR (KBr pellet): 2240 $cm^{-1}$ (CN); 1735 $cm^{-1}$ (C═O).

EXAMPLE III

Preparation of (4-carbitoxy-9-fluorenylidene)-malononitrile (III):

A solution of 4.0 grams (0.0138 mole) of (4-chloroformyl-9-fluorenylidene) as obtained in Example II(b) in 75 milliliters of methylene chloride was magnetically stirred in a 200 milliliter round-bottomed flask under a dry nitrogen atmosphere. 2.1 milliliters (0.0152 mole) of 2-(2-ethoxyethoxy)ethanol (carbitol) was added, this was followed by the addition of a solution of 2.1 milliliters of triethylamine in 5 milliliters of methylene chloride over a period of 3 minutes. The reaction mixture became cloudy due to the formation of triethylammonium chloride. The resulting mixture was allowed to react at room temperature for 4 hours. The reaction mixture was then treated in accordance with the procedure of Example II(c). The yield of pure Compound (III) was 4.08 grams. The melting point was 75.5°–76° C.

Analytical calculation for $C_{23}H_{20}N_2O_4$: C, 71.12; H, 5.19; N, 7.21.

Found: C, 71.01; H, 5.21; N, 7.21.

NMR ($CDCl_3$), delta: 1.2 (t, 3H); 3.4–4.0 (m, 8H); 4.6 (t, 2H); 7.2–8.6 (m, 7H).

IR (KBr pellet): 2240 $cm^{-1}$ (CN); 1730 $cm^{-1}$ (C=O).

EXAMPLE IV

Preparation of (4-n-butoxycarbonyl-2,7-dinitro-9-fluorenylidene)malonate (IV):

11.2 grams (0.05 mole) of fluorenone-4-carboxylic acid was placed in a 500-milliliter round-bottomed flask. There was then added to the flask at room temperature 300 milliliters of red fuming nitric acid over a period of 10 minutes. This was followed by the addition of 50 milliliters of concentrated sulfuric acid over a period of 5 minutes. The resulting solution was stirred at room temperature for 10 minutes and then poured slowly into 1.5 liters of ice cold water with constant swirling. The solid product, 2,7-dinitrofluorenone-4-carboxylic acid, was collected by suction filtration, washed with 100 milliliters of 5 percent aqueous hydrochloric acid solution, and dried in a vacuo at 60° C. for 24 hours. The dry weight of 2,7-dinitrofluorenone-4-carboxylic acid was 13.3 grams.

The conversion of 2,7-dinitrofluorenone-4-carboxylic acid (9.42 grams about 0.03 mole) into the corresponding n-butyl ester was effected in accordance with the procedure of Example I. The ester was purified by recrystallization from methylene chloride and hexane, and the yield was 7 grams.

In a 200-milliliter round-bottomed flash, there was then placed 4 grams (0.011 mole) of the n-butyl 2,7-dinitrofluorenone-4-carboxylate, 2.5 milliliters (0.016 mole) of distilled diethyl malonate and 25 milliliters of methylene choride. The solution was stirred magnetically and cooled with an ice-bath under a dry nitrogen atmosphere. To this solution was added 7 milliliters (0.065 mole) of titanium tetrachloride over a period of 5 minutes, followed by the addition of 10.4 milliliters (0.13 mole) of pyridine. The reaction mixture was then stirred at room temperature for 2 hours before being treated with 125 milliliters of water. The organic layer was separated in a separatory funnel, washed with 5 percent aqueous sodium bicarbonate solution and then with water. The organic solution was dried and evaporated, yielding the crude product which was recrystallized from isopropanol. The yield of (4-n-butoxycarbonyl-2,7-dinitro-9-fluorenylidene)malonate was 4.6 grams, m.p., 116.5°–117° C.

Analytical Calculation for $C_{25}H_{24}N_2O_{10}$: C, 58.59; H, 4.72; N, 5.46.

Found: C, 58,57; H, 4.90; N, 5.35.

NMR ($CDCl_3$), delta: 1.0–2.0 (m, 13H); 4.3–4.9 (m, 6H); 8.2–9.0 (m, 5H).

IR (KBr pellet): 1735 $cm^{-1}$ (C=O); 1540 $cm^{-1}$ (C—$NO_2$).

EXAMPLE V

A photoresponsive imaging member comprising an aluminum plate coated with a chlorine-doped, 100 PPM alloy of selenium arsenic, 99.5 percent of selenium was spray coated with a layer of Compound (1) in Merlon polycarbonate by means of a commercial spray gun. The solution for the overcoating was prepared by dissolving 10 grams of Compound (1), 27 grams of Merlon polycarbonate and 4 grams of N,N'-diphenyl-N,N'-bis(3-methylphenyl)-1,1'-[biphenyl]-4,4'-diamine in 300 milliliters of methylene chloride and 200 milliliters of 1,1,2-trichloroethane. The coating was dried in a forced air oven at 50° C. for 60 minutes, and an overcoat of a dry thickness of 2.5 microns was obtained. The fabricated photoresponsive device was cooled to room temperature and electrically tested as follows:

The resulting device was then tested electrically by charging positively with a corona and discharged by exposing to white light of wavelengths of 400–700 nm. The acceptance potential of the device after charging and its residual potential after exposure was then recorded. The procedure was repeated for different exposure energies of the incident radiation, and the exposure energy required to discharge the surface potential of the device to half of its original value was determined for the overcoated device. The acceptance potential was 1,000 volts, the residual potential was 100 volts, and the half decay exposure sensitivity was 12 ergs/$cm^2$. These values are the same as those obtained for a similar device without the overcoating. The electrical properties of this overcoated device remained essentially the same after 1,000 cycles of repeated charging and discharging.

EXAMPLE VI

A photoresponsive member was prepared by coating an aluminum drum with a photoconductive layer of an arsenic-selenium alloy doped with chlorine. The photoconductive layer had a thickness of 60 microns, and consisted of selenium with 0.5 percent of arsenic and 100 ppm of chlorine. This electrophotographic drum was then overcoated as follows:

A solution for the overcoating was prepared in accordance with the procedure of Example V. The solution was spray coated onto the aforementioned electrophotographic drum using a commercial spray gun in a humidity and temperature-controlled housing. The relative humidity was maintained at 35%, and the temperature at 20° C. during the spraying. The overcoated drum was thoroughly dried in a forced air oven at 45° C. for 60 minutes. The dry thickness of the overcoat was 2 microns. Electrical evaluation accomplished in accordance with Example V indicated that the acceptance potential, the residual potential, and the exposure sensitivity of the photoresponsive member were not affected by the overcoat. This overcoated electrophotographic drum was subsequently subject to print testing in a Xerox Corporation 2830 machine at a relative humidity ranging from 20 percent to 80 percent, and a temperature ranging from 8° C. to 30° C. A total of 3000 copies were producedusing this overcoated drum. The image quality of the copies as judged by visual observation was the same as that generated in the 2830 by a similar electrophotographic drum without the overcoating. Specifically, these copies evidenced excellent resolution, that is no image blurring, and no image deletions.

EXAMPLE VII

A photoresponsive imaging member comprising an aluminum drum coated with an arsenic-selenium alloy doped with chlorine, reference Example V, was coated by dip coating with an acrylic primer SHP-200, available from General Electric Company, as a 2% by weight solid mixture. The coating is thoroughly air-dried to form a primer layer having a thickness of 0.05–0.2 micron. An overcoat identical to that of Example VI was coated on top of the primer layer in accordance with the procedure of Example V. The resulting electrophotographic drum was dried in a forced air oven at 45° C. for 30 minutes. The dry thickness of the overcoat was 2 microns. Electrical evaluation and print testing of this device was accomplished by repeating the procedure of Example VI, and substantially similar results were achieved.

EXAMPLE VIII

A photoresponsive imaging member was prepared by providing an aluminum substrate with a thickness of 40 mils and coating thereover by vacuum evaporation an alloy of selenium arsenic, 99.5 percent selenium, with a thickness of 60 microns. The concentration of arsenic in the alloy is about 0.5% by weight. Subsequently, there was coated thereover an electron transport overcoating comprising 40% of Compound (II) and 10% N-isopropylcarbazole dispersed in 50% by weight of Makrolon polycarbonate. The overcoating was applied by means of a Bird Film applicator, and its dry thickness was 2 microns. This overcoated device was then electrically tested in accordance with the procedure of Example V, with similar results; however, this device exhibited a slight increase in residual potential (20 volts) as compared to a control device comprised of the same components but without an overcoat. Nevertheless, this increase in residual potential remained constant during the cycling test, and therefore did not affect the quality of copies produced.

EXAMPLE IX

Two identical organic photoresponsive imaging members were fabricated by coating a charge transport layer of a thickness of 20 microns on an aluminized Mylar substrate of a thickness of 50 microns. The transport layer was comprised of 50% of N,N'-diphenyl-N,N'-bis(3-methylphenyl)-1,1'-[biphenyl]-4,4'-diamine dispersed in 50% by weight of Makrolon polycarbonate. Photogenerator layers, 0.5 microns in thickness, comprising 30% of vanadyl phthalocyanine dispersed in 70% by weight of polyester PE-100 available from Goodyear were coated over the charge transport layer. One of these fabricated imaging members was overcoated with a layer of 40% of Compound (III) and 15% of the aforementioned diamine dispersed in 45% by weight of Merlon polycarbonate, available from Mobay Chemical Company, by spray coating at 20° C. and 30% R.H. using a commercial spray gun. The thickness of the overcoat was 2.5 microns. The other fabricated imaging member was left without an overcoat to serve as a control. These two devices were then electrically tested by charging positively to a surface potential of about 950 volts and discharging by exposing to 830 nm-monochromatic light. The results indicated that both devices possessed a similar acceptance potential, and a similar exposure sensitivity. However, the overcoated device displayed a dramatic improvement in its dark decay characteristics as compared to the control device as follows:

| | Acceptance Potential (V) | Dark Decay (V/s) | Half-Decay Exposure Sensitivity (ergs/cm$^2$) |
|---|---|---|---|
| Control Device | 930 | 240 | 27 |
| Overcoated Device | 960 | 35 | 26 |

V/s = volts per second

EXAMPLE X

A photoresponsive imaging member comprising a nickel belt of a thickness of 40 mils coated with a 60 micron-thick layer of a selenium-tellurium alloy was coated thereover with a layer of Compound (III) dispersed in phenoxy resin as follows:

A solution for the overcoating was prepared by dissolving 1.5 grams of Compound (III), 0.5 grams of the diamine of Example IX and 2 grams of phenoxy resin in 25 milliliters of methylene chloride. The solution was coated over the selenium-tellurium photoconductive layer by means of a Bird Film applicator. The coating was dried in a forced air oven at 135° C. for 30 minutes, resulting in a thickness of 1 micron. The overcoated photoresponsive imaging member was electrically tested in accordance with the procedure of Example V. The results indicated that the electrophotographic performance of the overcoated device was virtually substantially equivalent to the same device without an overcoating. Specifically, the acceptance potential for the overcoated device was 1050 volts, and the residual potential after exposure was 110 volts.

EXAMPLE XI

A photoresponsive imaging member similar to that of Example IX was then prepared on a ball-grained aluminium plate. Specifically, a photogenerator layer comprising trigonal selenium and the diamine of Example IX dispersed in poly(N-vinylcarbazole) was coated on top of the diamine transport layer. The thickness of the transport layer was 15 microns and that of the photogenerator was 2 microns. An overcoat layer comprising 40% of Compound (IV) in 60% by weight of Makrolon polycarbonate of a thickness of 1.5 micron was applied on top of the photogenerator layer by means of a Bird Film applicator. Electrical evaluation and print testing of this device was accomplished by repeating the procedure of Example VI, and substantially similar results were achieved. The overcoated device, however, displayed a consistently higher residual potential of 135 volts as compared to 105 volts for the unovercoated control.

Although the invention has now been described with reference to specific preferred embodiments, it is not intended to be limited thereto but rather those skilled in the art will recognize that variations and modifications may be made therein which are within the spirit of the invention and within the scope of the claims.

We claim:

1. An imaging member comprised of a supporting substrate, a hole transport layer comprised of an arylamine hole transporting compound dispersed in an inactive resinous binder, a photogenerating layer comprised of a photogenerating pigment optionally dispersed in a resinous binder, and as a protective topcoating an electron transporting layer compound of the following formula dispersed in a resinous binder

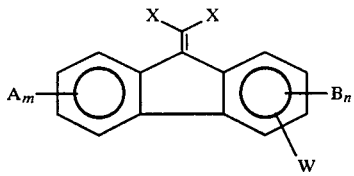

where X is cyano or alkoxycarbonyl groups, A and B are electron withdrawing groups, m is a number of from 0 to 2, n is the number 0 or 1, and W is an electron withdrawing group selected from the groups consisting of acyl (COR), alkoxycarbonyl (COOR), alkylaminocarbonyl (CONHR), and derivatives thereof.

2. An imaging member in accordance with claim 1 wherein R is an alkyl group of from 1 to 20 carbon atoms.

3. An imaging member in accordance with claim 1 wherein R is an alkyl group of from 1 to 6 carbon atoms.

4. An imaging member in accordance with claim 1 wherein R is an aryl group of from 6 to 24 carbon atoms.

5. An imaging member in accordance with claim 1 wherein R is an aryl-substituted alkyl group.

6. An imaging member in accordance with claim 1 wherein the protective overcoating is (4-butoxycarbonyl-9-fluorenylidene)malononitrile.

7. An imaging member in accordance with claim 1 wherein the protective top coating is (4-phenethoxycarbonyl-9-fluorenylidene)malononitrile.

8. An imaging member in accordance with claim 1 wherein the protective top coating is (4-carbitoxycarbonyl-9-fluorenylidene)malononitrile.

9. An imaging member in accordance with claim 1 wherein the protective top coating is diethyl(4-butoxycarbonyl-2,7-dinitro-9-fluorenylidene)malonate.

10. An imaging member in accordance with claim 1 wherein the photogenerating pigment is selected from inorganic photoconductive compositions, and organic photoconductive compositions.

11. An imaging member in accordance with claim 10 wherein the photogenerating pigment is selected from the group consisting of amorphous selenium, selenium alloys, and halogen doped selenium alloys.

12. An imaging member in accordance with claim 10 wherein the photogenerating pigment is selected from metal phthalocyanine, metal-free phthalocyanine, and vanadyl phthalocyanine.

13. An imaging member in accordance with claim 1 wherein the hole transporting compound is of the formula

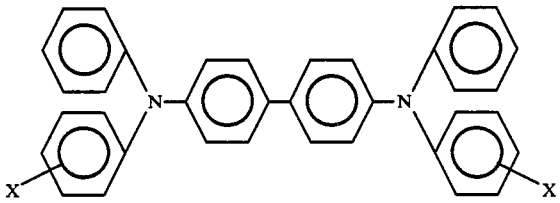

wherein X is an alkyl group, or halogen atom.

14. An imaging member in accordance with claim 13 wherein the alkyl group is methyl.

15. An imaging member in accordance with claim 13 wherein X is chlorine.

16. An imaging member in accordance with claim 13 wherein the photoconductive layer is comprised of inorganic photoconductive pigments, or organic photoconductive pigments.

17. An imaging member in accordance with claim 16 wherein the inorganic photoconductive pigments are comprised of amorphous selenium, or amorphous selenium alloys.

18. An imaging member in accordance with claim 16 wherein the organic photoconductive members are comprised of compounds selected from the group consisting of metal phthalocyanines, metal-free phthalocyanines, and vanadyl phthalocyanines.

19. A method of imaging which comprises forming electrostatic latent images on the imaging member of claim 1, developing this image with a developer composition comprised of resin particles, and pigment particles, transferring the resulting image to a suitable substrate, and optionally permanently affixing the image thereto.

20. A method of imaging in accordance with claim 19 wherein there results colored images with pigments comprised of cyan, magenta, and yellow.

21. An imaging member in accordance with claim 1 wherein X is an alkoxycarbonyl substituent.

22. An imaging member in accordance with claim 1 wherein A and B are selected from the group consisting of acyl, alkoxycarbonyl, nitro, and alkylaminocarbonyl.

23. An imaging member in accordance with claim 1 wherein m is the number zero, and n is the number zero.

24. An imaging member in accordance with claim 1 wherein the supporting substrate is aluminized Mylar.

25. An imaging member in accordance with claim 1 wherein the protective top coating is [4-(2-methoxyethylaminocarbonyl)-9-fluorenylidene]malononitrile.

26. An imaging member in accordance with claim 1 wherein the protective top coating is (4-n-butoxycarbonyl-2,7-dinitro-9-fluorenylidene)malononitrile.

27. An imaging member in accordance with claim 1 wherein the resinous binders are selected from the group consisting of polyesters, polyvinylbutyrals, polycarbonates, polyvinylcarbazole, epoxy resins, and phenoxy resins.

28. An imaging member in accordance with claim 1 wherein the overcoating layer is of a thickness of from about 0.1 micron to about 10 microns.

29. An imaging member consisting essentially of a supporting substrate, an arylamine hole transporting compound dispersed in an inactive resinous binder, a photogenerating layer comprised of a photogenerating pigment, and as a protective top coating an electron transporting compound selected from the group consisting of (4-n-butoxycarbonyl-9-fluorenylidene)-malononitrile, (4-phenethoxycarbonyl-9-fluorenylidene)malononitrile, (4-carbitoxycarbonyl-9-fluorenylidene)malononitrile, diethyl(4-n-butoxycarbonyl-2,7-dinitro-9-fluorenylidene)malonate, [4-(2-methoxyethylaminocarbonyl)-9-fluorenylidene]-malononitrile, and (4n-butoxycarbonyl-2,7-dinitro-9-fluorenylidene)malononitrile.

30. An imaging member in accordance with claim 36 wherein the hole transporting compound is of the formula

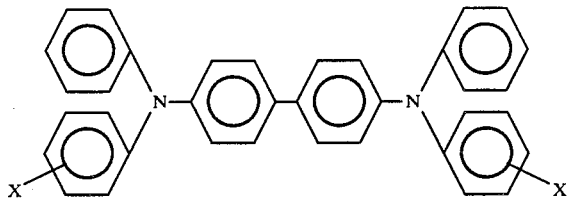

wherein X is alkyl group or a halogen atom.

31. An improved imaging member in accordance with claim 1 wherein there is further included in the overcoating layer an electron donor compound.

* * * * *

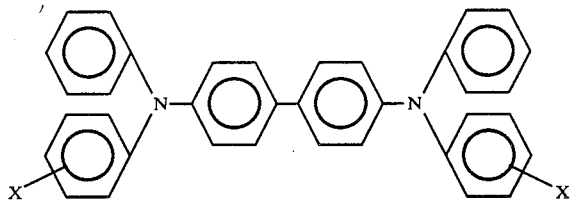

wherein X is alkyl group or a halogen atom.

31. An improved imaging member in accordance with claim 1 wherein there is further included in the overcoating layer an electron donor compound.

* * * * *